US006981448B2

(12) United States Patent
Kimura

(10) Patent No.: US 6,981,448 B2
(45) Date of Patent: Jan. 3, 2006

(54) METHOD OF CONTROLLING A DRYING APPARATUS FOR A PRINTING PRESS, DRYING APPARATUS AND PRINTING PRESS

(75) Inventor: Takashi Kimura, Fuchu (JP)

(73) Assignee: Ryobi Ltd. (JP)

( * ) Notice: Subject to any disclaimer, the term of this patent is extended or adjusted under 35 U.S.C. 154(b) by 37 days.

(21) Appl. No.: 10/850,869

(22) Filed: May 21, 2004

(65) Prior Publication Data

US 2004/0237824 A1 Dec. 2, 2004

(30) Foreign Application Priority Data

May 27, 2003 (JP) ..... 2003-149256

(51) Int. Cl.
*B41L 35/14* (2006.01)

(52) U.S. Cl. ..... 101/488; 101/484; 101/483

(58) Field of Classification Search ..... 101/488, 101/484, 483

See application file for complete search history.

(56) References Cited

U.S. PATENT DOCUMENTS 4,698,767 A * 10/1987 Wensel et al. ..... 700/127
5,937,761 A * 8/1999 Buschmann et al. ..... 101/424.1
6,877,247 B1 * 4/2005 DeMoore ..... 34/269
2003/0206225 A1 * 11/2003 Ihme ..... 347/130

FOREIGN PATENT DOCUMENTS

JP 02-039940 8/1990

* cited by examiner

*Primary Examiner*—Charles H. Nolan, Jr.
(74) *Attorney, Agent, or Firm*—Perkins Coie LLP

(57) ABSTRACT

In a drying apparatus equipped with a light source to dry a drying matter of a print by irradiating light of the light source to the print, a correlation between information relating to the time for which the light source is lit and information relating to the amount of light of the light source is preset. Then, the information relating to the elapsed time for which the light source is lit during the light source is lit is detected so that light of the light source is controlled to a constant amount, regardless of the elapsed time for which the light source is lit, based on information relating to a reference amount of light, which information is obtained from the preset correlation between the information relating to the time for which the light source is lit and the information relating to the amount of light with reference to the information relating to the elapsed time at the time of the detection.

10 Claims, 8 Drawing Sheets

METHOD OF CONTROLLING A DRYING APPARATUS FOR A PRINTING PRESS, DRYING APPARATUS AND PRINTING PRESS

CROSS REFERENCE TO RELATED APPLICATION

This application claims priority from Japanese Patent Application No. 2003-149256, which is incorporated herein by reference.

BACKGROUND OF THE INVENTION

1. Field of the Invention

The present invention relates to a method of controlling a drying apparatus for a printing press, in which a matter to be dried (hereinafter referred to a drying matter) of a print is dried by irradiating light from a light source to the print, a drying apparatus and a printing press.

2. Related Art

A conventional drying apparatus hitherto known such as in Japanese Patent No. 2958955 (JP-A-1990-39940) is equipped with a light source (e.g., a UV (ultraviolet ray) lamp), from which light is irradiated on a print so as to dry a drying matter (e.g., printing ink and vanish) on the print. The drying apparatus of this type is disposed on a print conveying passage so as to subsequently dry drying matters of oncoming prints.

In the drying apparatus equipped with a light source that irradiates light on a print, the amount of light is generally easy to be decreased as the time for which the drying apparatus is used or the time for which light is irradiated elapses. This poses a problem that drying capability for drying matters of prints is deteriorated in response to the decrease of the amount of light.

In order to address the problem that the amount of light is decreased as the time for which the light source is lit is elapsed, a well-experienced operator manually adjusts the light-source control voltage that controls the light source based on his experience so as to allow the light source to irradiate a proper amount of light, thereby maintaining the drying capability of the drying apparatus for better result in drying operation.

However, an operator with less experience is hard to properly maintain the drying capability of the drying apparatus even by the manual adjustment to the amount of light of the light source, causing insufficient drying of prints. An insufficiently dried matter of each print might be smeared to the next print stacked thereon (set-off), or cause a print to be adhered to the next print, so that it is likely to cause a print to be discarded or broke unfit for use (hereinafter simply referred to-broke).

In consideration of the above problems, it is an object of the present invention to provide a method of controlling a drying apparatus that dries drying matters of prints by irradiating light of a light source on prints, which allows the drying apparatus to have a constant capability to dry the drying matters even in a case where the amount of light of the light source is decreased due to the elapse of the lighting time of the light source, thereby maintaining a good drying quality of prints, preventing set-off of drying matters and adhesion of a print to the next print and hence limiting production of broke. It is another object of the present invention to provide a drying apparatus and a printing press that can carry out this method.

SUMMARY OF THE INVENTION

The present inventors repeatedly engaged in intensive study and found the following matters.

Before the drying operation of a drying apparatus equipped with a light source used in a printing press, a correlation between information relating to the time for which the light source is lit (for example of this information: the time for which the light source is lit) and information relating to the amount of light of the light source (an example of this information: the light-source control voltage that controls the amount of light of the light source) is preset, and during the light source is lit, information relating to the elapsed time for which the light source is lit (an example of this information: the elapsed time for which the light is lit) is detected. Accordingly, it is possible to control light of the light source to a constant amount, regardless of the elapsed time for which the light source is lit, based on information relating to a reference amount of light, which information is obtained from the preset correlation between the information relating to the time for which the light source is lit and the information relating to the amount of light with reference to the information relating to the elapsed time at the time of detection. Throughout the description, by a constant amount is meant a substantially constant amount which might have fluctuation within a permissible tolerance.

Decrease in the amount of light source appears in value of the electric current passing through the light source. In consideration of this fact, before the drying operation of a drying apparatus, a correlation between information relating to the value of the electric current passing through the light source (an example of this information: the value of the electric current passing through the light source) and information relating to the amount of light of the light source (an example of this information: the light-source control voltage that controls the amount of light of the light source), and during the light source is lit, information relating to the value of the electric current passing through the light source (an example of this information: the value of the electric current passing through the light source) is detected. Accordingly, it is possible to control light irradiated from the light source to a constant amount, regardless of the elapsed time for which the light source is lit, based on information relating to a reference amount of light, which information is obtained from the preset correlation between the information relating to the value of the electric current and the information relating to the amount of light with reference to the information relating to the value of the electric current passing through the light source at the time of the detection.

The present invention has been conceived on the basis of the above findings. In order to achieve the above object, there are provided a method of controlling a drying apparatus for a printing press, a drying apparatus and a printing press.

According to a first aspect of the present invention, there is provided a method of controlling a drying apparatus for a printing press, in which the drying apparatus is equipped with a light source to dry a drying matter of a print by irradiating light of the light source on the print, the method including presetting a correlation between information relating to the time for which the light source is lit and information relating to the amount of light of the light source; detecting information relating to the elapsed time for which the light source is lit during the light source is lit; and controlling light of the light source to a constant amount, regardless of the elapsed time for which the light source is lit, based on information relating to a reference amount of light, which information is obtained from the preset correlation between the information relating to the time for which the light source is lit and the information relating, to the amount of light with reference to the information relating to the elapsed time at the time of the detection.

According to a second aspect of the present invention, there is provided a method of controlling a drying apparatus for a printing press, in which the drying, apparatus is equipped with a light source to dry a drying matter of a print by irradiating light of the light source to the print, the method including presetting a correlation between information relating to the value of the electric current passing through the light source and information relating to the amount of light of the light source; detecting information relating, to the value of the electric current passing through the light source during the light source is lit; and controlling light of the light source to a constant amount, regardless of the elapsed time for which the light source is lit, based on information relating to a reference amount of light, which information is obtained from the preset correlation between the information relating to the value of the electric current and the information relating to the amount of light with reference to the information relating to the value of the electric current passing through the light, source at the time of the detection.

According to a third aspect of present invention, there is provided a drying apparatus for a printing press equipped with a light source to dry a drying matter of a print by irradiating light of the light source on the print, the drying apparatus including a setting means for presetting a correlation between information relating to the time for which the light source is lit and information relating to the amount of light of the light source; a detection device for detecting information relating to the elapsed time for which the light source is lit during the light source is lit; and a light-source control part for controlling light of the light source to a constant amount, regardless of the elapsed time for which the light source is lit, based on information relating to a reference amount of light, which information is obtained from the preset correlation between the information relating to the time for which the light source is lit and the information relating to the amount of light with reference to the information relating to the elapsed time at the time of the detection.

According to a fourth aspect of the present invention, there is provided a drying apparatus for a printing press equipped with a light source to dry a drying matter of a print by irradiating light of the light source on the print, the drying apparatus including a setting means for presetting a correlation between information relating to the value of the electric current passing through the light source and information relating to the amount of light of the light source; a detection device for detecting information relating to the value of the electric current passing through the light source during the light source is lit; and a light-source control part for controlling light of the light source to a constant amount, regardless of the elapsed time for which the light source is lit, based on information relating to a reference amount of light, which information is obtained from the preset correlation between the information relating to the value of the electric current and the information relating to the-amount of light, with reference to the information relating to the value of the electric current passing through the light source at the time of the detection.

According to a fifth aspect of the present invention, there is provided a printing press that includes the drying apparatus of the third aspect of the present invention, in which a correlation between information relating to the time for which the light source is lit and information relating to the amount of light of the light source is preset in the setting means; information relating to the elapsed time for which the light source is lit is detected by the detection device during the light source is lit; and light of the light source is controlled to a constant amount by the light-source control part, regardless of the elapsed time for which the light source is lit, based on information relating to a reference amount of light, which information is obtained from the preset correlation between the information relating to the time for which the light source is lit and the information relating to the amount of light, with reference to the information relating to the elapsed time at the time of the detection.

According to a sixth aspect of the present invention, there is provided a printing press that includes the drying apparatus of the fourth aspect of the present invention, in which a correlation between information relating to the value of the electric current passing through the light source and information relating to the amount of light of the light source is preset in the setting means; information relating to the value of the electric current passing through the light source is detected by the detection device during the light source is lit; and light of the light source is controlled to a constant amount by the light-source control part, regardless of the elapsed time for which the light source is lit, based on information relating to a reference amount of light, which information is obtained from the preset correlation between the information relating to the value of the electric current and the information relating to the amount of light, with reference to the information relating to the value of the electric current passing through the light source at the time of the detection.

According to the above controlling method, the drying apparatus and the printing press, in which light of the light source is controlled to a constant amount, regardless of the elapsed time for which the light source is lit, based on information relating to a reference amount of light, which information is obtained from the preset correlation between the information relating to the time for which the light source is lit and the information relating to the amount of light with reference to the information relating to the elapsed time at the time of the detection, it is possible to allow the drying apparatus to maintain a substantially constant drying capability even in a case where the light intensity characteristics of the light source is decreased as the time for which the light source is lit is elapsed, and thus maintain an optimum drying condition of the prints. As a result, set-off of drying matters to the next print or adhesion of a print to the next print can be prevented, thereby limiting the possibility to produce broke. The same desirable effects can be produced by the method, drying apparatus and printing press, in which light of the light source is controlled to a constant amount, regardless of the elapsed time for which the light source is lit, based on information relating to a reference amount of light, which information is obtained from the preset correlation between the information relating to the value of the electric current and the information relating to the amount of light with reference to the information relating to the value of the electric current at the time of the detection.

In the method and the drying apparatus of the first and third aspect of the present invention, as the information relating to the time for which the light source is lit, the time for which the light source is lit can be cited as a typical example, while various information can be employed as long as it is related to the time for which the light source is lit. For example, the number of prints, the operation time of the printing press or the like may be employed. Also, as the information relating to the amount of light of the light source, the amount of light of the light source can be cited as a typical example.

In a case where the time for which the light source is lit is designated as the information relating to the time for which the light source is lit while the amount of light of the light source is designated as the information relating to the amount of light of the light source, a correlation between the time for which the light source is lit and the amount of light of the light source may be designated as the preset correlation between the information relating to the time for which the light source is lit and the information relating to the amount of light of the light source, so that the time for which the light source is accumulated and detected as the elapsed time for which the light source is ht during the light source is lit. Accordingly, a light-source control voltage that controls the light source to emit a constant amount of light regardless of the elapsed time for which the light is lit is calculated based on a reference amount of light obtained from the preset correlation between the time for which the light source is lit and the amount of light of the light source with reference to the elapsed time at the time of the detection. The thus calculated light-source control voltage can control the light source to emit a constant amount of light regardless of the elapsed time for which the light source is lit. In this case, the correlation between the time for which the light source is lit and the amount of light of the light source may be set by using a light-amount compensation table for storage of the aforesaid correlation, or a calculation formula to calculate an approximate correlation to the aforesaid correlation.

According to the above case, the correlation preset in the drying apparatus between the information relating to the time for which the light source is lit and the information relating to the amount of light of the light source is the correlation between the time for which the light source is lit and the amount of light of the light source. As the detection device for detecting information relating to the elapsed time for which the light source is lit, a device that accumulates the time for which the light source is lit and detects an accumulated time as the elapsed time is employed. Accordingly, the light-source control part may calculate a light-source control voltage, which controls light of the light source to a constant amount regardless of the elapsed time for which the light source is lit, based on a reference amount of light obtained from the correlation between the time for which the light source is lit and the amount of light of the light source preset in the setting means, with reference to the elapsed time, for which the light source is lit, detected by the detecting device, and control light of the light source to a constant amount regardless of the elapsed time, for which the light source is lit, by using the thus calculated light-source control voltage. Also, the setting means may contain a light-amount compensation table for storage of the correlation between the time for which the light source is lit and the amount of light of the light source, or a calculation formula to calculate an approximate correlation to the aforesaid correlation.

In the control method and the drying apparatus using the information relating to the value of the electric current passing through the light source, the value of the electric current passing through the light source can be cited as a typical example of this information. The impedance of the light source may be used as the information. Also, the amount of light of the light source can be cited as a typical example of the information relating to the amount of light of the light Source.

In a case where the value of the electric current passing through the light source is designated as the information relating to the value of the electric current passing through the fight source while the amount of light of the light source is designated as the information relating to the amount of light of the light source, a correlation between the value of the electric current passing through the light source and the amount of light of the light source may be designated as the preset correlation between the information relating to the value of the electric current passing through the light source and the information relating to the amount of light of the light source, so that the value of the electric current passing through the light source is detected during the light source is lit. Accordingly, a light-source control voltage that controls the light source to emit a constant amount of light regardless of the value of the electric current passing through the light source is calculated based on a reference amount of light obtained from the preset correlation between the value of the electric current passing through the light source and the amount of light of the light source. The thus calculated light-source control voltage can control the light source to emit a constant amount of light regardless of the elapsed time for which the light source is lit. In this case, the correlation between the value of the electric current passing through the light source and the amount of light of the light source may be set by using a light-amount compensation table for storage of the aforesaid correlation, or a calculation formula to calculate an approximate correlation to the aforesaid correlation.

According to the above case, the correlation preset in the drying apparatus between the information relating to the value of the electric current passing through the light source and the information relating to the amount of light of the light source is the correlation between the value of the electric current passing through the light source and the amount of light of the light source. As the detection device for detecting information relating to the value of the electric current passing through the light source, a device that detects the value of the electric current passing through the light source is employed. Accordingly, the light-source control part may calculate a light-source control voltage, which controls light emitted from the light source to a constant amount regardless of the value of the electric current passing through the light source, based on a reference amount of light obtained from the correlation between the value of the electric current passing through the light source and the amount of light of the light source preset in the setting means, with reference to the value of the electric current passing through the light source detected by the detecting device, and control light of the light source to a constant amount regardless of the elapsed time, for which the light source is lit, by using the thus calculated light-source control voltage. Also, the setting means may contain a light-amount compensation table for storage of the correlation between the value of the electric current passing through the light source and the amount of light of the light source, or a calculation formula to calculate an approximate correlation to the aforesaid correlation.

In either case, as the light source, an UV (ultraviolet) lamp can be cited as a typical example, although it is not necessarily limited to this. Alternatively, an IR (infrared) lamp can be used.

BRIEF DESCRIPTION OF THE DRAWINGS

The above, and other objects, features and advantages of the present invention will become apparent from the detailed description thereof in conjunction with the accompanying drawings wherein.

DESCRIPTION OF THE PREFERRED EMBODIMENTS

Figure 1:
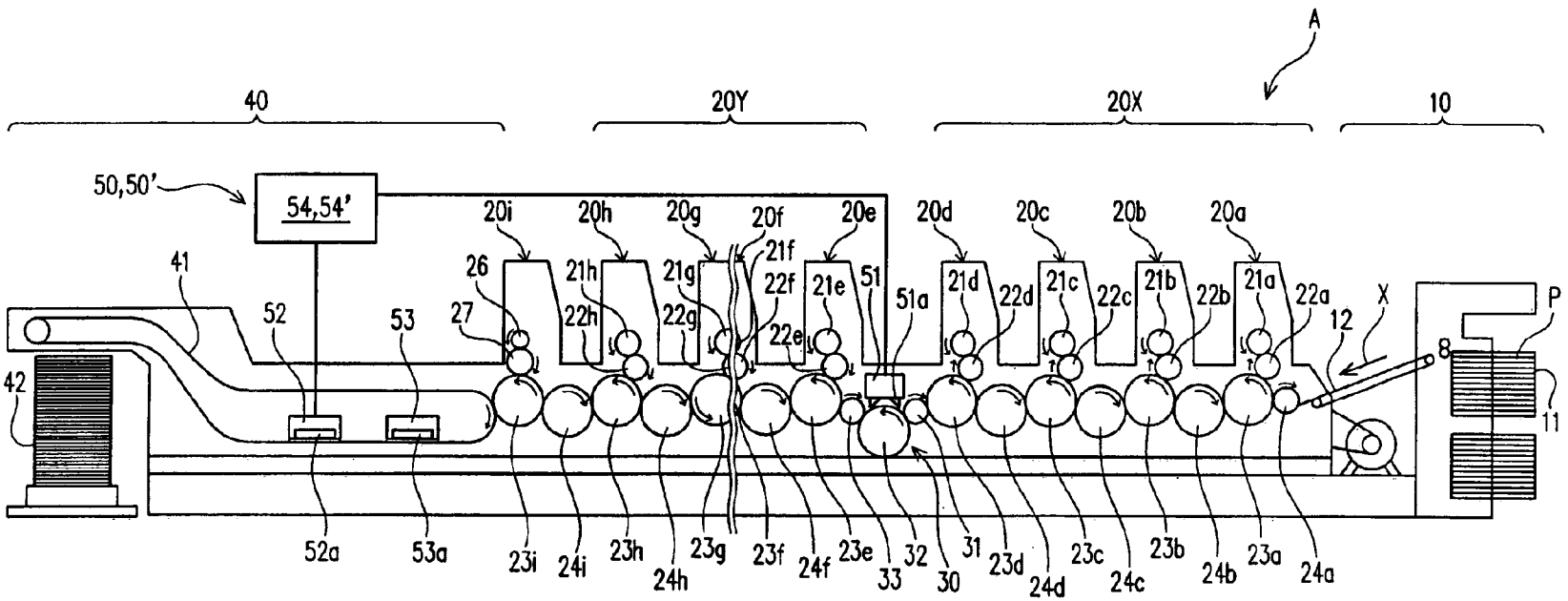
FIG. 1 is a schematic side elevational view of a printing press equipped with a drying apparatus that carries out the method of controlling the drying apparatus according to the present invention.

Various embodiments of the present invention will be herein described with reference to the drawings attached hereto. FIG. 1 is a schematic side elevational view illustrating a structure of a printing press A equipped with a drying apparatus (a first drying apparatus 50 or a second drying apparatus 50') that carries out the method of controlling the drying apparatus according to the present invention.

The printing press A of FIG. 1 is designed to be capable of performing single-side printing operation and both-side printing operation, and includes a sheet feeding section 10 for feeding substrates (sheets of paper in this embodiment) P to first and second printing sections 20X, 20Y hereinafter described, the first and second printing sections 20X, 20Y at which sheets P fed from the sheet feeding section 10 are printed, a turnover device 30 located between the first and second printing sections 20X, 20Y for turning sheets P with one side printed at the first printing section located upstream thereof along the sheet transfer direction ("X" in FIG. 1) upside down and a sheet discharging section 40 for discharging sheets printed at the first and second printing sections 20X, 20Y, as well as the first drying apparatus 50 or the second drying apparatus 50'.

More specifically, the printing press A is operated so that when the single-side printing operation is performed, sheets P are fed from the sheet feeding section 10 to the first and second printing sections 20X, 20Y, thereby allowing the sheets P fed to have one side printed by plural printing units of the first and second printing sections 20X, 20Y (eight printing units 20*a*–20*b* in this embodiment) and then to be discharged through the sheet discharging section 40, and when the both-side printing operation is performed, sheets P are fed from the sheet feeding section 10 to the first printing section 20X, thereby allowing the sheets P to have one side printed by plural printing units (four printing units 20*a*–20*d* in this embodiment) of the first printing section 20X located upstream of the turnover device 30 along the sheet transfer direction X, and be turned upside down by the turnover device 30, then have another side printed by plural printing units (four printing units 20*e*–20*h* in this embodiment) of the second printing section 20Y located downstream of the turnover device 30 along the sheet transfer direction X, and then be discharged through the sheet discharging section 40.

The sheet feeding section 10 includes a sheet storage part 11 and a sheet feeding part 12. The sheet storage part 11 is designed to be capable of storing plural sheets P. The sheet feeding part 12 is designed to be capable of pulling sheets P stored in the sheet storage part 11 one by one and transfer the same towards the first printing section 20X. Thus, the sheets P are fed to the first printing section 20X.

The printing press A includes a surface treatment unit 20*i* in addition to the first and second printing sections 20X, 20Y. As described above, the first printing section 20X includes the printing units 20*a*–20*d*, while the second printing section 20Y includes the printing units 20*e*–20*h*.

In the printing units 20*a*–20*h* of the first and second printing sections 20X, 20Y, plate cylinders 21*a*–21*h*, rubber cylinders 22*a*–22*h* and impression cylinders 23*a*–23*h* are arranged in combination in the respective units to constitute an essential structure of each printing unit. The surface treatment unit 20*i* includes an anilox roller 26, a varnish cylinder 27 and an impression cylinder 23*i*.

A reference code 24*a* represents a transfer cylinder in the printing unit 20*a*, while reference codes 24*b*–24*d* represent transfer cylinders in the printing units 20*b*–20*d*, and reference codes 24*f*–24*h* represent transfer cylinders in the printing units 20*f*–20*b*. A transfer cylinder 24*g* of the printing unit 20*g* is omitted in FIG. 1.

Regarding the turnover device 30, reference codes 31, 32, and 33 respectively represent a transfer cylinder, a turnover and transfer cylinder, and a turnover cylinder.

In the respective printing units 20*a*–20*h*, printing plates (not shown) are mounted on the plate cylinders 21*a*–21*h*. Ink and water are supplied onto these plates and then ink thereon is transferred onto the rubber cylinders 22*a*–22*h* as the rotation of the printing plates. Ink transferred on the rubber cylinders 22*a*–22*h* are then transferred on sheets P, which are held between the rubber cylinders 22*a*–22*b* and the impression cylinders 23*a*–23*h*. Whereby, sheets P fed from the sheet feeding section 10 can be printed corresponding to the printing plates mounted thereon.

At the surface treatment unit 201, varnish for surface treatment is supplied to the anilox roller 26 and then transferred therefrom onto the varnish cylinder 27. Varnish transferred on the varnish cylinder 27 is then transferred onto sheets P upcoming as being held between the varnish cylinder 27 and the impression cylinder 23*i*. Whereby, the surface treatment can be applied on the sheets P coming from the printing unit 20*h*.

The sheet discharging section 40 includes a transfer member 41 and a storage member 42. At this sheet discharging section 40, sheets P transferred by the impression cylinder 23*i* of the surface treatment unit 20*i* each are held at its leading end by a holding part (not shown) of the transfer member 41, and are transferred along a substantially lower side of the transfer member 41 into the storage member 42, as illustrated in FIG. 1. Sheets P thus transferred by the transfer member 41 are accommodated in the storage member 42.

Figure 2A:
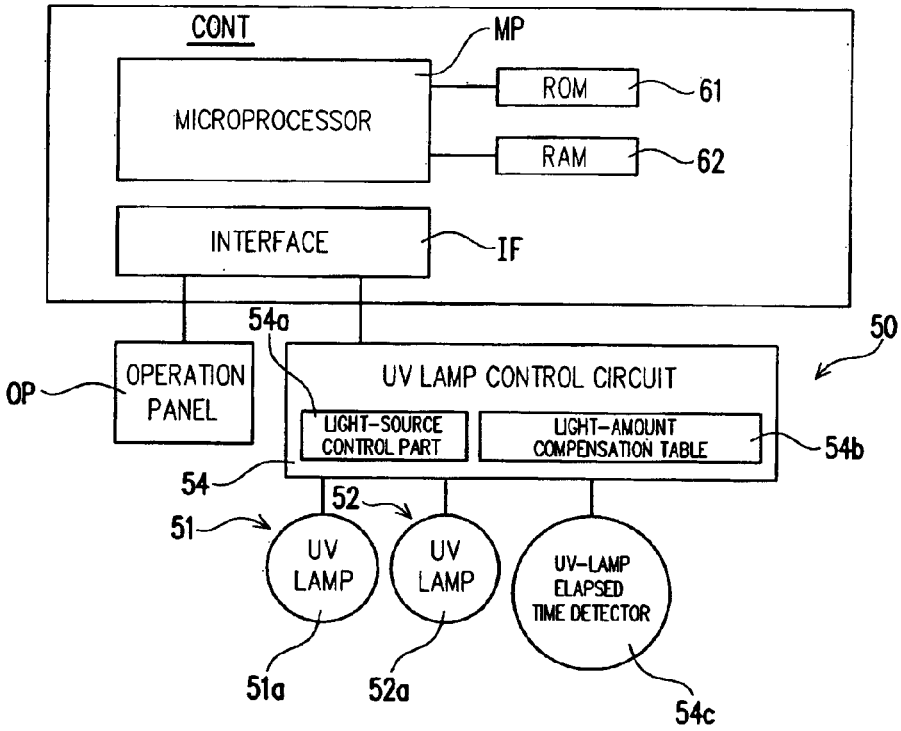
FIG. 2A is a schematic block diagram illustrating a structure of an essential portion including a main control part and a first-UV-lamp control circuit in a case where the drying apparatus of the first embodiment is mounted in the printing press.

The first drying apparatus 50 in a case where it is provided in the printing press A includes an interdeck dryer member 51 located above the turnover device 30, dryer members 52, 53 located along an inner side of the transfer member 41 and a first UV lamp control circuit 54 (see also FIG. 2A). The second drying apparatus 50' in a case where it is provided in the printing press A has the same arrangement, except that instead of the first UV lamp control circuit 54 of the first drying apparatus, a second UV lamp control circuit 54' (see FIG. 2B) is provided.

The interdeck dryer member 51 is herein a UV dryer provided as a light source with a UV (ultraviolet ray) lamp 51 a that can irradiate UV rays from above the transfer cylinder 32 of the turnover device 30. Printing ink on sheets P (substrates) printed at the first printing section 20X is dried by irradiating UV rays from the UV lamp 51*a*.

The dryer member 52 is a UV dryer provided as a light source with a UV (ultraviolet ray) lamp 52*a* that can irradiate UV rays from inside of the transfer member 41. The dryer member 53 is an IR (infrared ray) dryer provided as a light source with an IR lamp 53*a* that can irradiate IR rays from inside of the transfer member 41. These UV dryer 52 and IR dryer 53 are arranged so as to irradiate UV rays from the UV lamp 52*a* and IR rays from the IR lamp 53*a* to sheets P (substrates) that are printed at the first and second printing sections 20X, 20Y and coated with varnish, thereby drying printing ink and varnish of the sheets P.

Figure 2B:
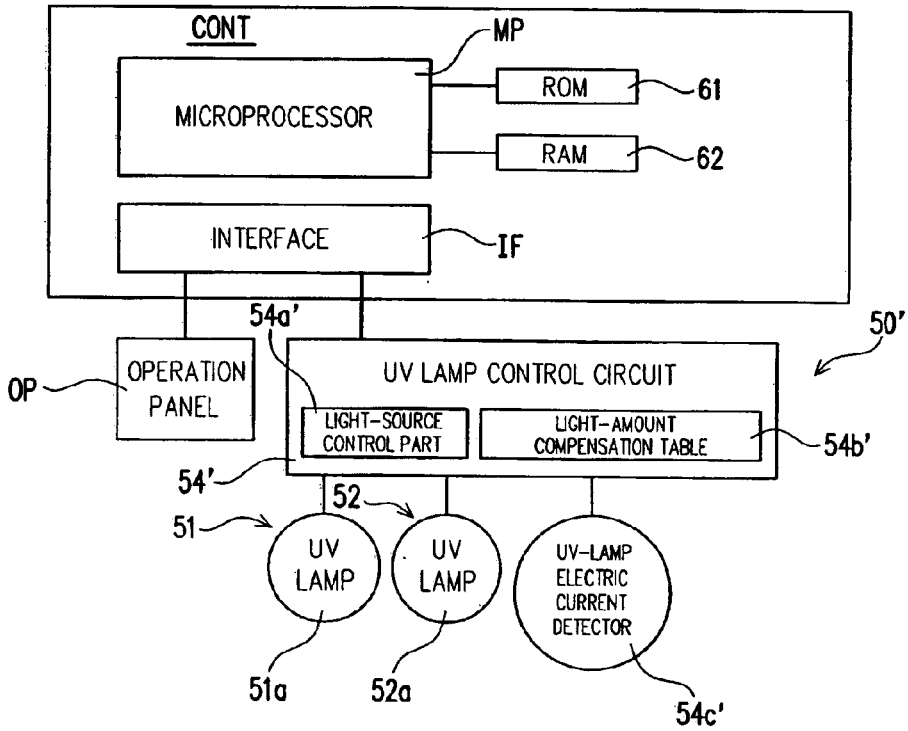
FIG. 2B is a schematic block diagram illustrating a structure of an essential portion including the main control part and a second-UV-lamp control circuit in a case where the drying apparatus of the second embodiment is mounted in the printing press.

The UV lamps 51*a*, 52*a* of the UV dryer members 51, 52 are herein connected to the first UV lamp control circuit 54 as illustrated in FIG. 2A or the second UV lamp control circuit 54' as illustrated in FIG. 2B so as to have the amount of light adjusted by the control of the light-source control voltage under the control of these UV lamp control circuits. These UV lamps 51*a*, 52*a* are of the same structure and therefore have the same light intensity characteristics relative to the time for which they are lit and the same electric current characteristics relative to the amount of light of these UV lamps. Accordingly, throughout the detailed description, which will be made hereinafter for the manner of compensation to these characteristics, the light intensity characteristics mentioned for either UV lamp is also applied to another UV lamp.

The printing press A of FIG. 1 further includes a main control part CONT (not illustrated in FIG. 1; see FIGS. 2A and 2B). FIG. 2A illustrates the arrangements of essential members such as the main control part CONT and the first UV lamp control circuit 54 in a case where the first drying apparatus 50 is provided in the printing press A. FIG. 2B illustrates the arrangements of essential members such as the main control part CONT and the second UV lamp control circuit 54' in a case where the second drying apparatus 50' is provided in the printing press A.

The main control part CONT is connected to various units of the printing press A, while these units are omitted in FIGS. 2A and 2B, so as to control the entire operation of the printing press A. As illustrated in FIGS. 2A and 2B, the main control part CONT includes a ROM 61 that stores programs and data required for processing printing operation, a microprocessor MP that reads out data from the ROM 61 and processes the same, a RAM 62 that temporarily stores data required for the operation of the microprocessor MP, and an interface IF that inputs data into the microprocessor MP and outputs data therefrom. An operation panel OP is connected to the main control part CONT via the interface IF for input of the information required for printing and operation information. The first UV lamp control circuit 54 of FIG. 2A or the second UV lamp control circuit 54' is also connected to the main control part CONT.

As illustrated in FIG. 2A, the first U-V lamp control circuit 54 is to control drying operation applied to sheets P through the UV lamps 51*a*, 52*a* under the control of the main control part CONT. The first UV lamp control circuit 54 includes a setting means (herein a light-amount compensation table 54*b*) for setting therein a correlation between the information relating to the time for which the UV lamp 51*a*, 52*a* is lit (herein, the information is the time for which the UV lamp 51*a*, 52 is lit) and the information relating to the amount of light of the UV lamp 51*a*, 52*a* (herein, the information is the amount of light of the UV lamp 51*a*, 52*a*) and a light-source control part 54*a*, and connects to a detection device (herein an elapsed time detector 54*c* for detecting the elapsed time for which an UV lamp is lit) for detecting information relating to the elapsed time for which the light source is lit.

Figure 3:
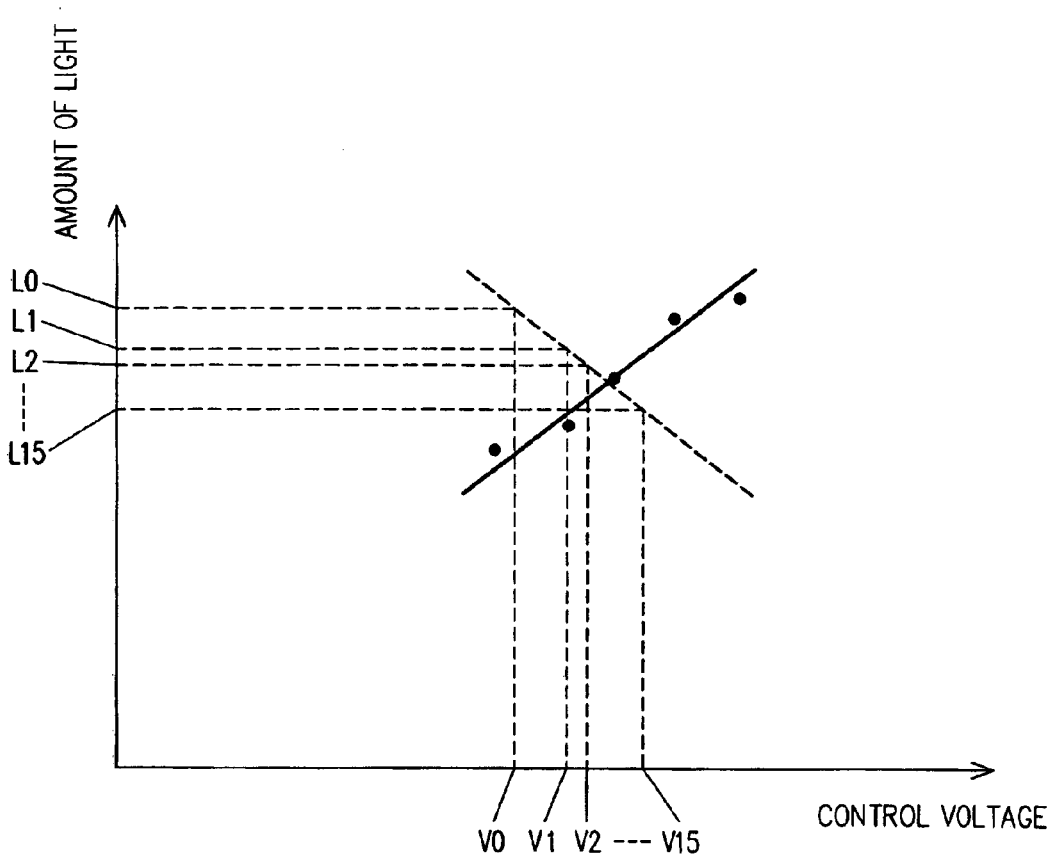
FIG. 3 is a graph illustrating an example of the light intensity characteristics relative to the light-source control voltage in solid line and a graph plotted by taking the reciprocal of the aforesaid graph.
Figure 4:
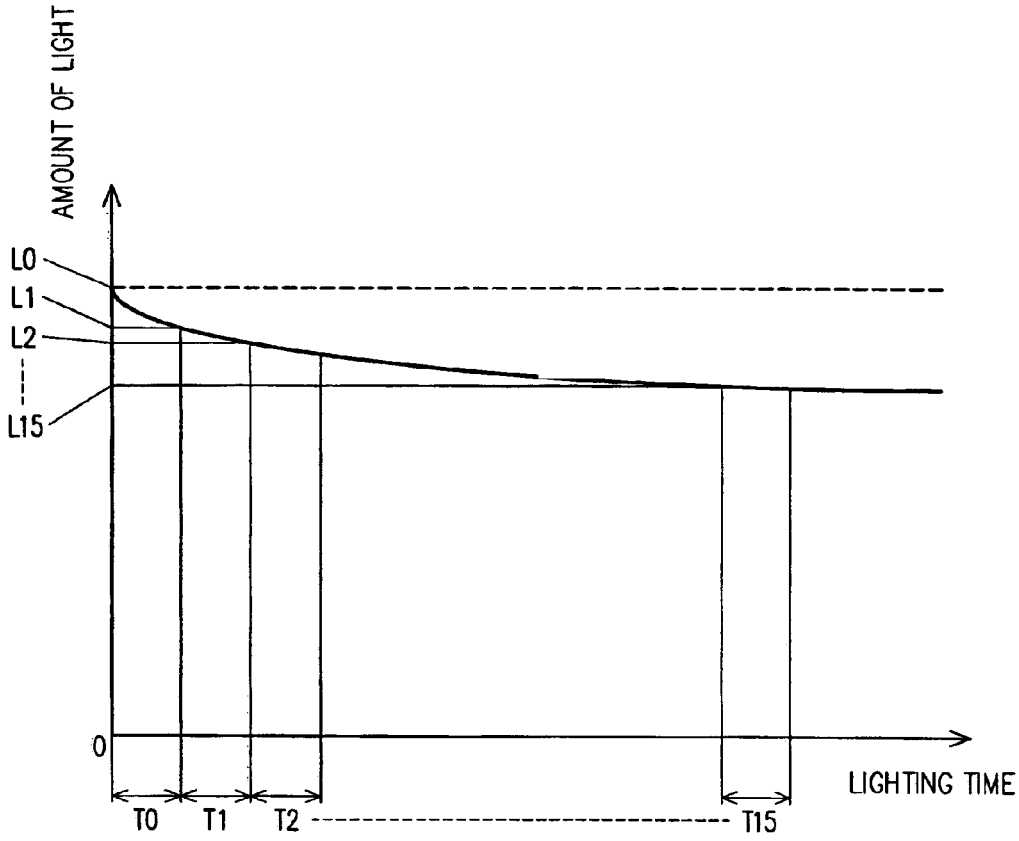
FIG. 4 is a graph illustrating an example of the light intensity characteristics relative to the time for which a UV lamp is lit.

FIG. 3 is a graph illustrating an example of the light intensity characteristic relative to the light-source control voltage in solid line. FIG. 4 is a graph illustrating an example of the light intensity characteristics relative to the time for which the UV lamp 51*a*, 52*a* is lit.

As illustrated in FIG. 4, the amount of light of the UV lamp 51*a*, 52 tends to decrease as the time for which the lamp is lit is elapsed. As illustrated by the graph in solid line, the light source control voltage has a relation substantially proportional to the amount of light of the UV lamp, so that by increasing the light-source control voltage, the amount of light of the UV lamp can be increased, while by decreasing the light-source control voltage, the amount of light of the UV lamp can be decreased.

Accordingly, as illustrated in FIG. 4, by applying a light-source control voltage of such a degree as to allow control of light of the UV lamp 51*a*, 52*a* to a constant amount even if the light intensity characteristics of the UV lamp 51*a*, 52*a* is decreased as the time for which the UV lamp is lit is elapsed, to the UV lamp 51*a*, 52*a*, it is possible to control light of the UV lamp 51*a*, 52*a* to a constant amount regardless of the elapsed time for which the UV lamp is lit. The description will be hereinafter made for this control operation. The light intensity characteristics relative to the elapsed time for which a light source is lit can be previously obtained by a test such as a continuous lighting test in which a light source is continuously lit, intermittent lighting test in which light-on and light-off are repeatedly performed every a certain period of time, or any other test.

The light-amount compensation table 54*b* of FIG. 2A is to store a correlation between the time for which the UV lamp 51*a*, 52*a* is lit and the amount of light, as illustrated in FIG. 4. More specifically, the light-amount compensation table 54*b* stores a light-amount compensation value relative to the time for which the UV lamp 51*a*, 52*a* is lit, as described below. The table numbers 0–15 respectively correspond to the lighting times of the UV lamps 51*a*, 52*a*, T0–T15, and the amounts of light L0–L15 relative to the lighting times T0–T15 are stored.

| TABLE NOS. | 0 | 1 | 2 | . . . | 15 |
|---|---|---|---|---|---|
| LIGHTING TIMES | T0 | T1 | T2 | . . . | T15 |
| AMOUNTS OF LIGHT | L0 | L1 | L2 | . . . | L15 |

The elapsed time detector 54*c* for detecting the elapsed time for which an UV lamp is lit is to accumulate the time for which the UV lamp 51*a*, 52*a* is lit (a lighting time) and detect the accumulated time as an elapsed time, and includes a timer means for measuring the lighting time of the UV lamp 51*a*, 52*a*, a storing means for storing the lighting time, and a calculation means for accumulating the lighting time of the UV lamp measured by the timer means to the lighting time stored in the storing means and again storing the thus accumulated lighting time in the storing means. The life of the UV lamp 51*a*, 52*a* may be preset so as to allow indication of the timing of the replacement of the lamp when the elapsed time detector 54*c* detects that the life of the UV lamp 51*a*, 52*a* has been expired.

Figure 5:
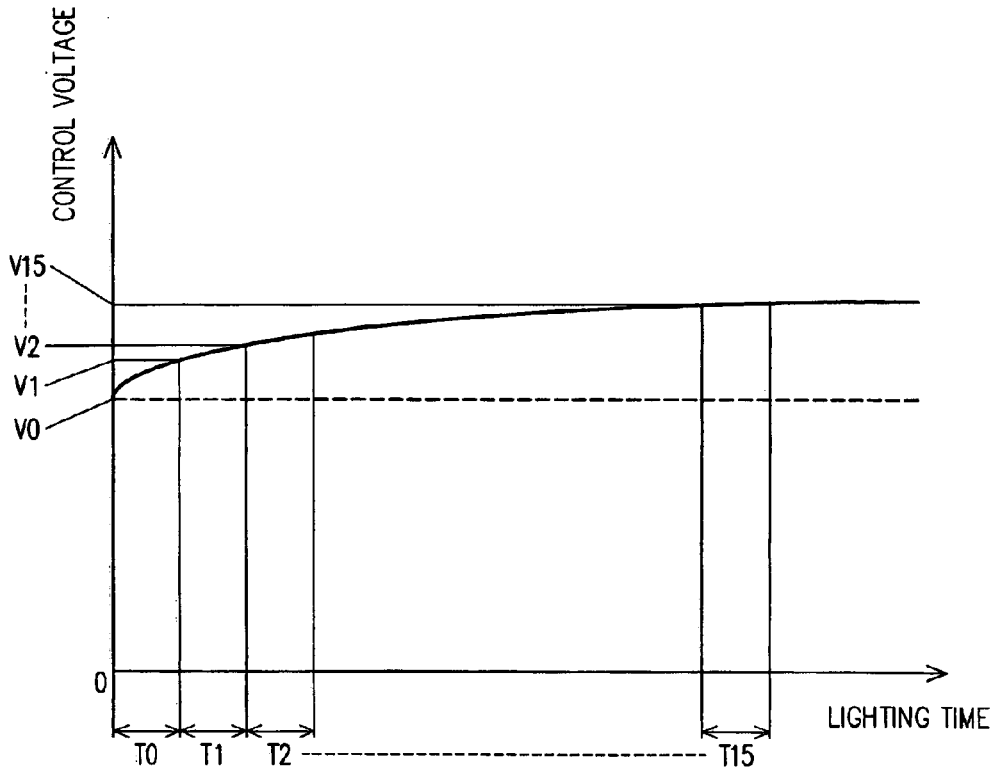
FIG. 5 is a graph illustrating a correlation between the time for which a UV lamp is lit and the light-source control voltage that controls light of the UV lamp to a constant amount regardless of the elapsed time for which the UV lamp is lit.

The light-source control part 54*a* of FIG. 2A calculates a light-source control voltage Vx that controls light of the UV lamp 51*a*, 52*a* to a constant amount regardless of the elapsed time for which the UV lamp 51*a*, 52*a* is lit, from a light amount Lx obtained from the preset correlation between the lighting times: T0–T15 and the amounts of light: L0–L15 wit reference to an elapsed lighting time Tx detected at the elapsed time detector 54*c*. This light-source control voltage Vx can be calculated by, for example, taking the reciprocal of the values in the correlation between the light-source control voltage of the UV lamp 51*a*, 52*a* and the amount of light (see the broken lines in FIG. 3). FIG. 5 illustrates the correlation between the time for which the UV lamp 51*a*, 52*a* is lit and the light-source control voltage that controls light of the UV lamp 51*a*, 52*a* to a constant amount regardless of the elapsed time for which the UV lamp 51*a*, 52*a* is lit. In a specific example with reference to FIG. 5, when the elapsed time exceeds the range of T0 and currently lies in the range of T1, the light of the UV lamp 51*a*, 52*a* can be controlled to a constant amount by setting the light-source control voltage to V1 that is greater than V0.

In an example as illustrated in FIG. 2A, the information relating to the time for which each UV lamp 51*a*, 52*a* is lit is the time for which the UV lamp 51*a*, 52*a* is lit. Alternatively, this information may be the number of sheets P, the operation time of the printing press A or the like. In this case, the elapsed time detector 54*c* for detecting the elapsed time for which a light source is lit may be replaced with a counter for counting the number of sheets P, or an elapsed time detector that accumulates the operation time of the printing press A and detects the accumulated time as a detected value.

In the above example, the setting means is the light-amount compensation table 54*b* for storing the correlation between the time for which the UV lamp 51*a*, 52*a* is lit and the amount of light. Alternatively, this setting means may be a calculation means provided with a calculation formula that can calculate an approximate correlation to the aforesaid correlation. In this case, the approximate correlation may be calculated by this calculation formula, using a least square approximation method based on data in a graph as illustrated in FIG. 4.

As illustrated in FIG. 2B, the second UV lamp control circuit 54' is to control the drying operation applied to sheets P through the UV lamps 51*a*, 52*a* under the control of the main control part CONT. This second UV lamp control circuit 54' includes a setting means (herein a light-amount compensation table 54*b*') for presetting of a correlation between information relating to the value of the electric current passing through the UV lamp 51*a*, 52*a* (herein, the information is the value of the electric current of the UV lamp 51*a*, 52*a*) and information relating to the amount of light of the UV lamp 51*a*, 52*a* (herein, the information is the amount of light of the UV lamp 51*a*, 52*a*) and a light-source control part 54*a*', and connects to a detection device for detecting the information relating to the value of the electric current (herein a UV-lamp electric current detector 54*c*').

Figure 6:
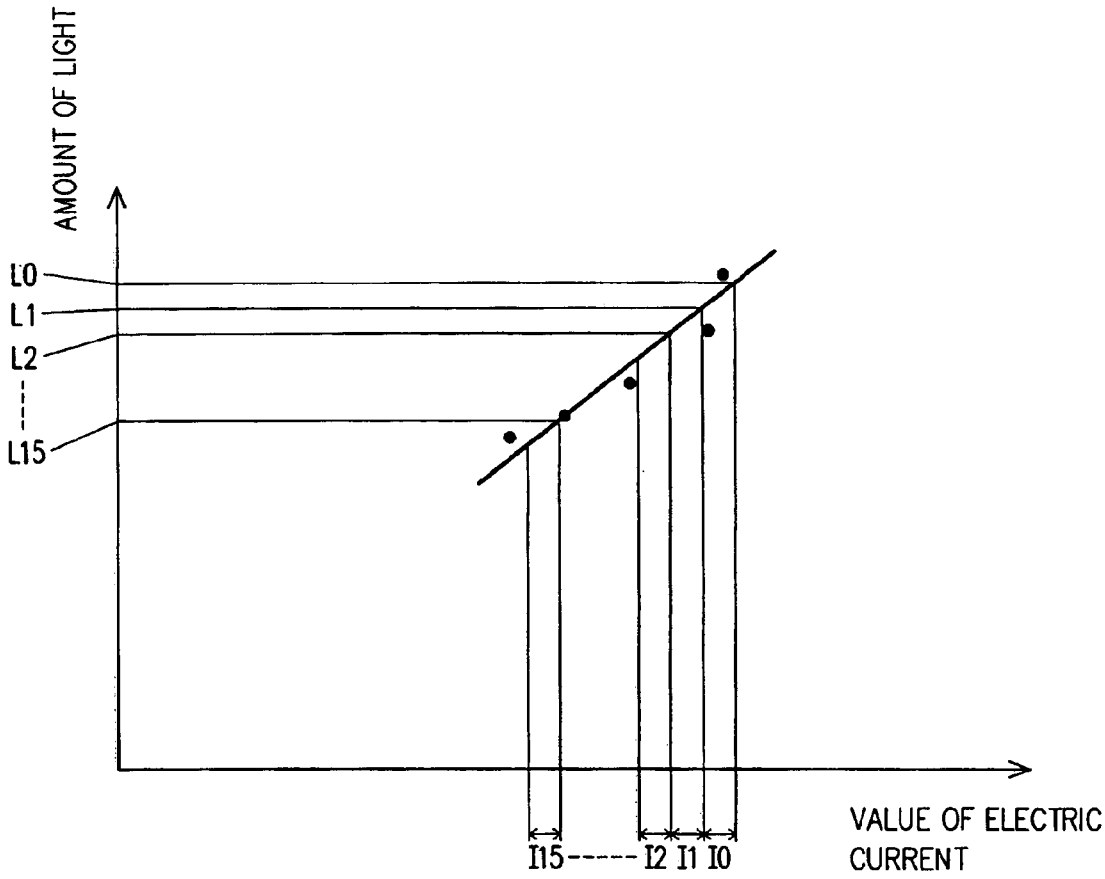
FIG. 6 is a graph illustrating an example of the electric current characteristics relative to the amount of light of the UV lamp.

FIG. 6 is a graph illustrating an example of the electric current characteristics relative to the amount of light of the UV lamp 51*a*, 52*a*. As illustrated in FIG. 6, decrease in amount of light of the UV lamp 51*a*, 52*a* appears in value of the electric current passing through the UV lamp 51*a*, 52*a*.

As described above, the light source control voltage illustrated in solid line in FIG. 3 has a relation substantially proportional to the amount of light of the UV lamp, so that by increasing the light-source control voltage, the amount of light of the UV lamp can be increased, while by decreasing the light-source control voltage, the amount of light of the UV lamp can be decreased.

Accordingly, as illustrated in FIG. 6, by applying a light-source control voltage of such a degree as to allow control of light of the UV lamp 51*a*, 52*a* to a constant amount regardless of that the electric current characteristics decreases due to decrease of the amount of light, to the UV lamp 51*a*, 52*a*, it is possible to control light of the UV lamp 51*a*, 52*a* to a constant amount regardless of the value of the electric current passing therethrough. The description will be hereinafter made for this control operation.

The light-amount compensation table 54*b*' of FIG. 2B is to store a correlation between the value of the electric current passing through the UV lamp 51*a*, 52*a* and the amount of light. More specifically, the light-amount compensation table 54*b*' stores a light-amount compensation value relative to the value of the electric current passing through the UV lamp 51*a*, 52*a*, as described below. The table numbers 0–15 respectively correspond to the values of the electric current passing through the UV lamp 51*a*, 52*a*, I0–I15, and the amounts of light L0–L15 relative to the values of the eclectic current I0–I15 are stored.

| TABLE NOS. | 0 | 1 | 2 | . . . | 15 |
|---|---|---|---|---|---|
| VALUES OF ELECTRIC CURRENT | I0 | I1 | I2 | . . . | I15 |
| AMOUNTS OF LIGHT | L0 | L1 | L2 | . . . | L15 |

The UV-lamp electric current detector 54*c*' as illustrated in FIG. 2B is herein designed to detect the value of the electric current passing through the UV lamp 51*a*, 52*a* during the UV lamp 51*a*, 52*a* is lit.

Figure 7:
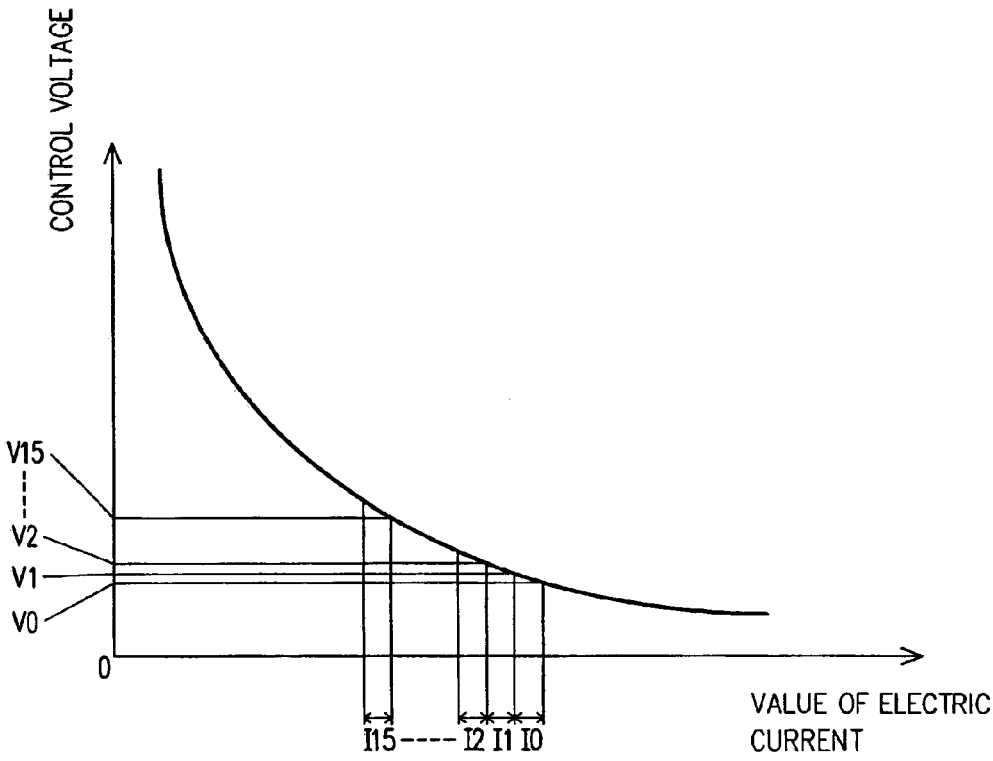
FIG. 7 is a graph illustrating a correlation between the value of the electric current passing through a UV lamp and the light-source control voltage that controls light of the UV lamp to a constant amount regardless of the elapsed time for which the UV lamp is lit.

The light-source control part 54*a*' of FIG. 2B calculates a light-source control voltage Vx that controls light of the UV-lamp 51*a*, 52*a* to a constant amount regardless of the value of the electric current, from a light amount Lx obtained from the preset correlation between the values of the electric current: I0–I15 and the amounts of light: L0–L15 with reference to an electric current value Ix detected at the UV-lamp electric current detector 54*c*'. As described above, this light-source control voltage Vx can be calculated by, for example, taking the reciprocal of the values in the correlation between the light-source control voltage of the UV lamp 51*a*, 52*a* and the amount of light (see the broken lines in FIG. 3). FIG. 7 illustrates the correlation between the value of the electric current passing through the UV lamp 51*a*, 52*a* and the light-source control voltage that controls light of the UV lamp 51*a*, 52*a* to a constant amount regardless of the elapsed time for which the UV lamp 51*a*, 52*a* is lit. In a specific example with reference to FIG. 7, when the value of the electric current is decreased from I0 and lies in the range of I1, the light of the UV lamp 51*a*, 52*a* can be controlled to a constant amount by setting the light-source control voltage to V1 that is greater than V0.

In an example of FIG. 2B, the setting means is the light-amount compensation table 54*b*' for storing the correlation between the value of the electric current passing through the UV lamp 51*a*, 52*a* and the amount of light. Alternatively, this setting means may be a calculation means provided with a calculation formula that can calculate an approximate correlation to the aforesaid correlation. In this case, the approximate correlation may be calculated by this calculation formula, using a least square approximation method based on data in a graph as illustrated in FIG. 6.

Figure 8A:
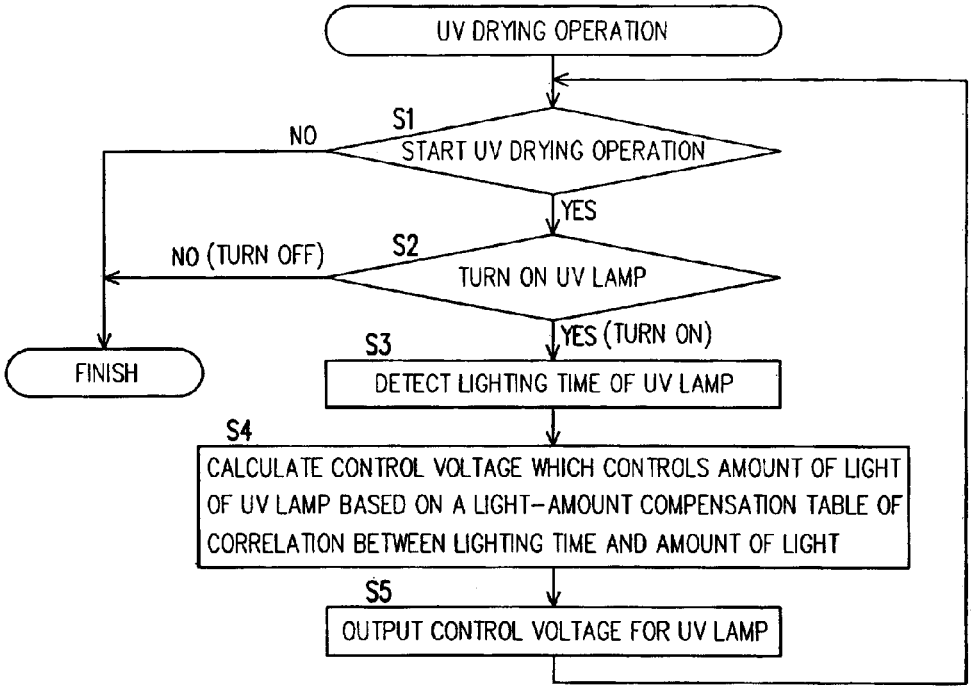
FIG. 8A is a flowchart illustrating an example of a drying operation flow applied to dry prints by the drying apparatus of the first embodiment.
Figure 8B:
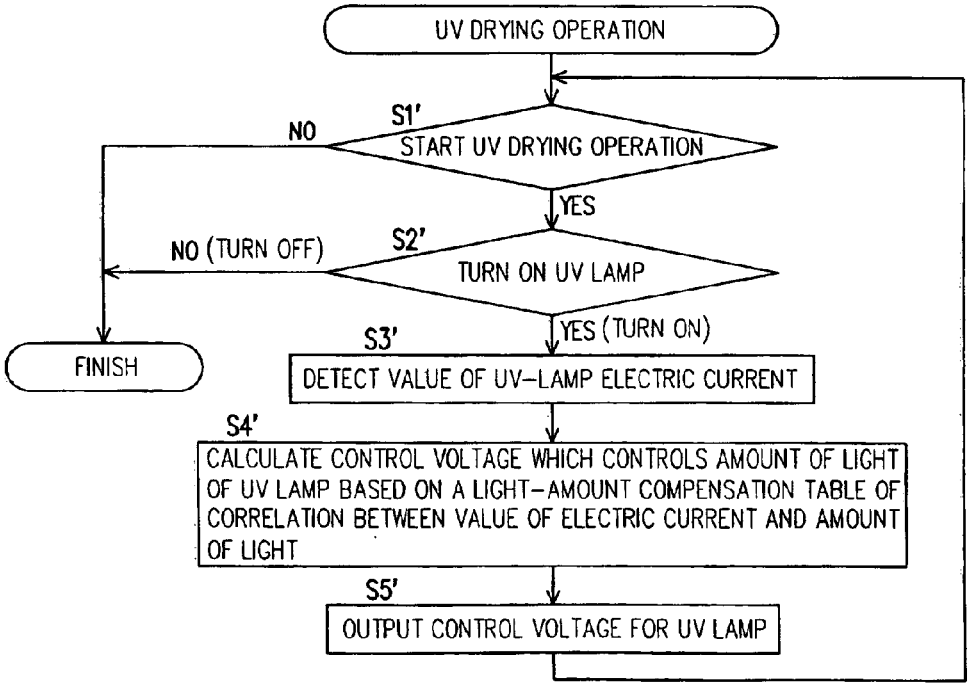
FIG. 8B is a flowchart illustrating an example of a drying operation flow applied to dry prints by the drying apparatus of the second embodiment.

FIG. 8A is a flowchart illustrating an example of drying operation flow applied to dry prints by the first drying apparatus 50. FIG. 8B is a flowchart illustrating an example of a drying operation flow applied to dry prints by the second drying apparatus 50'.

The first drying apparatus 50 as illustrated in FIGS. 1 and 2A starts its drying operation upon receiving control command from the main control part CONT (Step S1). Then, the UV lamps 51*a*, 52*a* are turned on upon receiving command (Step S2), and during they are lit, the elapsed time, for which the UV-lamp 51*a*, 52*a* is lit, is detected by the elapsed time detector 54*c* (Step S3). Then, in the correlation represented in broken line of FIG. 3, the light-source control part 54*a* calculates a light-source control voltage that controls light of the UV lamp 51*a*, 52*a* to a constant amount regardless of the elapsed time for which the UV lamp 51*a*, 52*a* is lit, from a light amount Lx obtained from the preset correlation between the lighting times: T0–T15 and the amounts of light: L0–L15 with reference to the elapsed time detected at the elapsed time detector 54*c*: (Step S4). The amount of light of the UV lamp 51*a*, 52*a* is thus controlled by this control voltage to a constant amount regardless of the elapsed time for which the UV lamp 51*a*, 52*a* is lit (Step S5). Then, returning to Step S1, this process is repeatedly performed. Then, the drying operation is finished upon receiving command to finish the drying operation (Step S1) or command to turn off the UV lamps 51*a*, 52*a* (Step S2) from the main control part CONT. The second drying apparatus 50' as illustrated in FIGS. 1 and 2B starts its drying operation upon receiving control command from the main control part CONT (Step S1'). Then, the UV lamps 51*a*, 52*a* are turned on upon receiving command (Step S2'), and during they are lit, the value of the electric current passing through the UV lamp 51*a*, 52*a* is detected by the UV-lamp electric current detector 54*c*' (Step S3'). Then, in the correlation represented in broken line of FIG. 3, the light-source control part 54*a* ' calculates a light-source control voltage that controls light of the UV lamp 51*a*, 52*a* to a constant amount regardless of the value of the electric current passing through the UV lamp 51*a*, 52*a*, from a light amount Lx obtained from the correlation preset in the light-amount compensation table 54*b*' between the values of the electric current: I0–I15 and the amounts of light: L0–15 with reference to the value of the electric current detected at the UV-lamp electric current detector 54*c*' (Step S4'). The amount of light of the UV-Lamp 51*a*, 52*a* is thus controlled by this control voltage to a constant amount regardless of the elapsed time for which the UV lamp 51*a*, 52*a* is lit (Step S5'). Then, returning to Step S1', this process is repeatedly performed. Then, the drying operation is finished upon receiving command to finish the drying operation (Step S1') or command to turn off the UV lamps 51*a*, 52*a* (Step S2') from the main control part CONT.

According to the above described first and second drying apparatuses 50, 50', and the printing press A, the first drying apparatus 50 is so designed as to control fight of the UV lamp 51*a*, 52*a* to a constant amount regardless of the elapsed time for which the UV lamp 51*a*, 52*a* is lit, based on a light-source control voltage Vx obtained from the correlation between the lighting time: TO–T15 and the amount of light: L0–L15 preset in the light-amount compensation table 54*b*, with reference to an elapsed time Tx for which the UV lamp is lit detected at the elapsed time detector 54*c*. The second drying, apparatus 50' is so designed as to control light of the UV lamp 51*a*, 52*a* to a constant amount regardless of the elapsed time for which the UV lamp 51*a*, 52*a* is, lit, based on a light-source control voltage Vx obtained from the correlation between the value of the electric current: I0–I15 and the amount of light: L0–L15 preset in the light-amount compensation table 54*b*', with reference to an electric current value Ix detected at the UV-lamp electric current detector 54*c*'. Accordingly, it is possible to allow each drying apparatus 50, 50' to maintain a substantially constant drying capability even in a case where the light intensity characteristics of the UV lamp 51*a*, 52*a* is decreased as the time for which the UV lamp 51*a*, 52*a* is lit is elapsed, and thus maintain an optimum drying condition of prints. As a result, set-off of drying matters to the next print or adhesion of a print to the next print can be prevented, thereby limiting the possibility to produce broke.

The description of the above embodiments was made by taking for example a case where an object to be controlled is an UV lamp. It is a matter of course that an IR lamp can be an object to be controlled in the same manner as the UV lamp.

This specification is by no means intended to restrict the present invention to the preferred embodiments set forth therein. Various modifications to the method of controlling a drying apparatus for a printing press, drying apparatus and printing press, as described herein, may be made by those skilled in the art without departing from the spirit and scope of the present invention, as defined in the appended claims.

What is claimed is:

1. A method of controlling a drying apparatus for a printing press, in which said drying apparatus is equipped with a light source to dry a drying matter of a print by irradiating light of said light source on said print, comprising:

presetting a correlation between information relating to the time for which said light source is lit and information relating to the amount of light of said light source;

detecting information relating to the elapsed time for which the light source is lit during said light source is lit; and controlling light of the light source to a constant amount, regardless of the elapsed time for which the light source is lit, based on information relating to a reference amount of light, said information relating to the reference amount being obtained from the preset correlation between said information relating to the time for which the light source is lit and said information relating to the amount of light with reference to said information relating to the elapsed time at the time of the detection.

2. A method of controlling a drying apparatus for a printing press, in which said drying apparatus is equipped with a light source to dry a drying matter of a print by irradiating light of said light source on said print, comprising:

presetting a correlation between information relating to the value of the electric current passing through said light source and information relating to the amount of light of said light source;

detecting information relating to the value of the electric current passing through said light source during said light source is lit; and controlling light of the light source to a constant amount, regardless of the elapsed time for which the light source is lit, based on information relating to a reference amount of light, said information relating to the reference amount being obtained from the preset correlation between said information relating to the value of the electric current and said information relating to the amount of light with reference to said information relating to the value of the electric current at the time of the detection.

3. The method of controlling a drying apparatus according to claim 1, wherein said light source is a UV lamp.

4. The method of controlling a drying apparatus according to claim 2, wherein said light source is a UV lamp.

5. A drying apparatus for a printing press equipped with a light source to dry a drying matter of a print by irradiating light of said .light source on said print, comprising:

a setting means for presetting a correlation between information relating to the time for which said light source is lit and information relating to the amount of light of said light source;

a detection device for detecting information relating to the elapsed time for which said light source is lit during said light source is lit; and a light source control part for controlling light of said light source to a constant amount, regardless of the elapsed time for which said light source is lit, based on information relating to a reference amount of light, said information relating to the reference amount of light being obtained from the preset correlation between said information relating to the time for which said light source is lit and said information relating to the amount of light with reference to said information relating to the elapsed time at the time of the detection.

6. A drying apparatus for a printing press equipped with a light source to dry a drying matter of a print by irradiating light of said light source on said print, comprising:

a setting means for presetting a correlation between information relating to the value of the electric current passing through said light source and information relating to the amount of light of said light source;

a detection device for detecting information relating to the value of the electric current passing through said light source during said light source is lit; and a light source control part for controlling light of said light source to a constant amount, regardless of the elapsed time for which said light source is lit, based on information relating to a reference amount of light, said information relating to the reference amount of light being obtained from the preset correlation between said information relating to the value of the electric current passing through said light source and said information relating to the amount of light with reference to said information relating to the elapsed time at the time of the detection.

7. The drying apparatus according to claim 5, wherein said light source is a UV lamp.

8. The drying apparatus according to claim 6, wherein said light source is a UV lamp.

9. A printing press equipped with said drying apparatus according to claim 5.

10. A printing press equipped with said drying apparatus according to claim 6.

* * * * *